United States Patent [19]

Kusuyama

[11] 4,174,469

[45] Nov. 13, 1979

[54] ADJUSTABLE DIRECTIVITY MICROPHONE INCORPORATED IN A TAPE RECORDER CASING

[75] Inventor: Michio Kusuyama, Hachioji City, Japan

[73] Assignee: Olympus Optical Co., Ltd., Tokyo, Japan

[21] Appl. No.: 924,667

[22] Filed: Jul. 14, 1978

Related U.S. Application Data

[63] Continuation-in-part of Ser. No. 804,434, Jun. 7, 1977, abandoned.

[30] Foreign Application Priority Data

Jun. 11, 1976 [JP] Japan ..... 51-76135
Jun. 11, 1976 [JP] Japan ..... 51-76138

[51] Int. Cl.[2] ..... H04R 1/38

[52] U.S. Cl. ..... 179/121 D; 179/179

[58] Field of Search ..... 179/121 D, 107 FD, 179, 179/178, 1 DM

[56] References Cited

U.S. PATENT DOCUMENTS 3,870,820 3/1975 Suzuki et al. ..... 179/121 D

*Primary Examiner*—George G. Stellar
*Attorney, Agent, or Firm*—Toren, McGeady and Stanger

[57] ABSTRACT

A microphone device used for a tape recorder comprises a microphone body and a casing for accommodating the microphone therein. The casing is provided with acoustic inlet holes at its front wall and its side wall. The acoustic inlet holes provided on its side wall can be opened and closed by a shielding member.

1 Claim, 5 Drawing Figures

ADJUSTABLE DIRECTIVITY MICROPHONE INCORPORATED IN A TAPE RECORDER CASING

BACKGROUND OF THE INVENTION

CROSS-REFERENCE TO RELATED APPLICATIONS

This application is a continuation-in-part of my application Ser. No. 804,434 filed June 7, 1977, now abandoned.

FIELD OF THE INVENTION

The present invention relates to a microphone device used for a tape recorder and the like.

DESCRIPTION OF THE PRIOR ART

As a microphone of external connection type or incorporated type for a tape recorder, use is often made of a condenser microphone.

In the tape recorder using the microphone of external connection type the condenser microphone can simultaneously catch acoustic sounds from many directions with high sensitivity. In the tape recorder using the microphone of incorporated type the acoustic inlet holes are provided on different walls of the casing near the microphone to simultaneously catch acoustic sounds from many directions with high sensitivity.

There is however disadvantage that the acoustic sound from one direction cannot selectively be caught.

SUMMARY OF THE INVENTION

An object of the present invention is to eliminate the above mentioned defect of the conventional microphone device.

Another object of the present invention is to provide a microphone device which can not only catch acoustic sounds from many directions simultaneously but also selectively catches an acoustic sound from one direction.

A microphone device according to the present invention comprises an inner cylinder for accommodating a microphone body therein and having acoustic inlet holes at the side surface, an outer cylinder for surrounding the inner cylinder and having acoustic inlet holes at the front surface and the side surface near the microphone, and a cover provided to the outer cylinder for opening and closing the acoustic inlet holes at the side surfaces of the cylinders. The cover can be moved in the direction of the axis of the outer cylinder to open and close the acoustic inlet holes at the side surfaces of the cylinders. The cover can be rotated about an axis of the outer cylinder to open and close the acoustic inlet holes at the side surfaces of the cylinders.

According to the present invention a microphone device comprises a microphone body, a tape recorder casing for incorporating the microphone therein and having acoustic inlet holes provided on the front surface and the side surfaces near the microphone, and a shielding plate for opening and closing the acoustic inlet holes on the side surfaces of the casing. The acoustic inlet holes are provided on at least one side surface of the tape recorder casing.

DESCRIPTION OF THE PREFERRED EMBODIMENT

Figure 1:
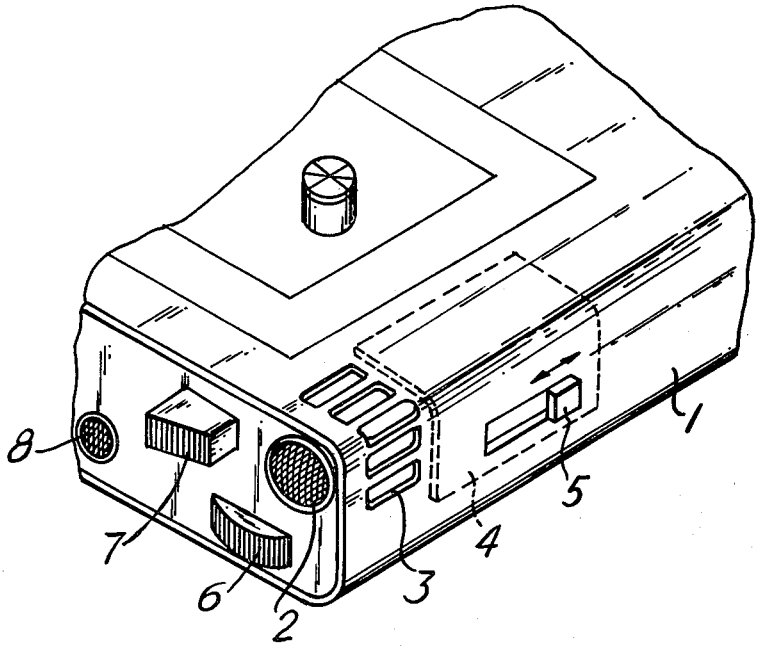
FIG. 1 shows a perspective view of a tape recorder having a microphone device according to the present invention.

Referring now to FIG. 1, one embodiment of a microphone device used for a tape recorder is shown. Reference numeral 1 is a casing of a tape recorder having acoustic inlet holes 2 and 3 at the front end surface and the side surface of the casing near the incorporated microphone (not shown) respectively. In the casing 1 is provided a shielding plate 4 which is slidable along the side surface having the acoustic inlet hole 3 thereon so as to open and close the acoustic inlet hole 3. This shielding plate 4 is slidably operated by a knob 5 from the outside of the casing 1.

In FIG. 1 reference numeral 6 is a volume knob for the tape recorder and reference numeral 7 is a shift button for the cassette tape.

With such construction, under such condition that the shielding plate 4 is moved backward at the position shown in FIG. 1, the acoustic inlet hole 3 at the side surface of the casing is opened.

Under this condition, the acoustic sound is transmitted to the microphone through the acoustic inlet holes 2 and 3 at the front end surface and the side surface of the casing. In this casing, the acoustic sound transmitted from the side of the casing 1 reaches the microphone through the both acoustic inlet holes 2 and 3 in opposite phases, cancelled with each other and attenuated, so that the sound transmitted from the front end surface direction of the casing is clearly emphasized by attenuation of the sound transmitted from the side surface direction. The microphone can selectively catch the sound transmitted only from the front end surface direction of said casing 1.

When the shielding plate 4 is slid forwards by the knob 5 and the acoustic inlet holes 3 at the side surface of the casing is closed, the sound is transmitted to the microphone only through the acoustic inlet hole 2 at the front end surface of the casing. In this case, the sound transmitted through the acoustic inlet hole 2 is mixed with the sound at the side of the casing 1, so that the sounds from many directions can be caught by the microphone simultaneously.

Thus, the present invention provides a shielding plate for opening and closing an acoustic inlet hole at the side surface of the casing in the tape recorder having acoustic inlet holes at the front end surface and the side surface near the microphone. Accordingly, by opening and closing acoustic inlet holes by the shielding plate, not only the sound transmitted from many directions but also the sound transmitted only from one direction, if necessary, can selectively be caught.

Figure 4:
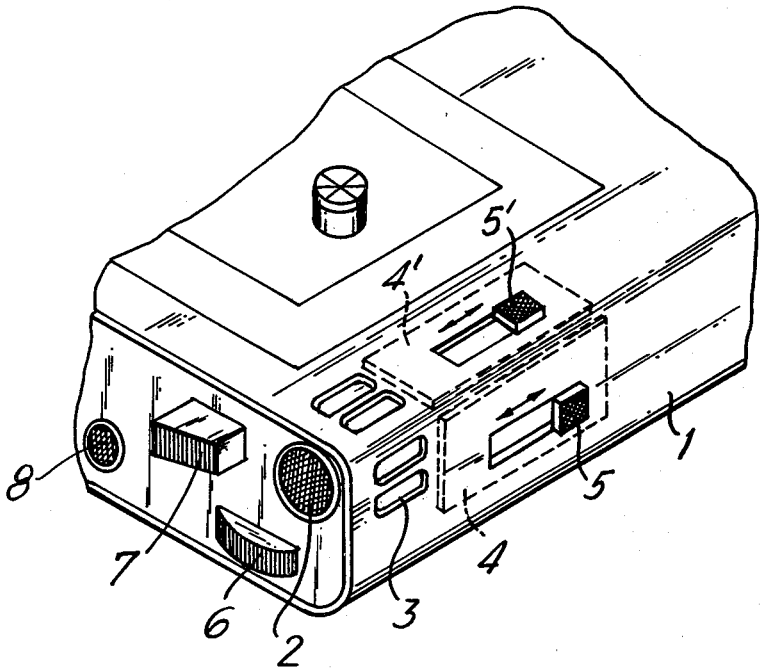
FIG. 4 is a perspective view showing a tape recorder with fourth embodiment of a microphone device according to the present invention.

Alternatively, the shielding plate 4 can be divided into two shielding plates 4' and 4, one for each side of the casing 1, with a knob 5 or 5' for each plate 4 or 4' as shown in FIG. 4. In this case the directivity at the side of the casing 1 which is closed acoustic inlet holes by the shielding plate becomes excellent while the directivity at the side of the casing 1 having opened holes becomes inferior.

Figure 2:
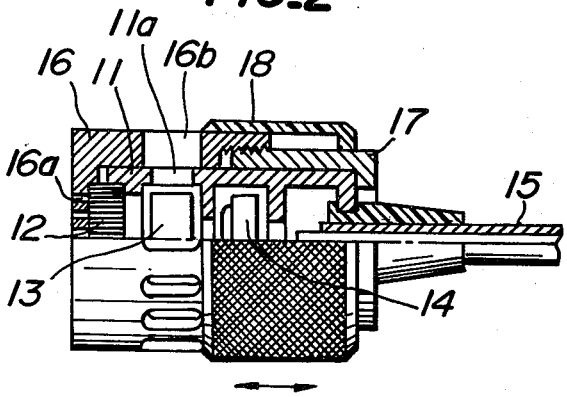
FIG. 2 is a partial cross-section showing second embodiment of a microphone device according to the present invention.

Second embodiment of the present invention is now explained with reference to FIG. 2. Reference numeral 11 is a microphone accommodating inner cylinder, which accommodates a microphone capsule 12 having a condenser microphone therein, an amplifier 13 and a cell or battery 14 at one opening end, and a connection cord 15 let out of the other opening end. In this case, the inner cylinder 11 is provided with acoustic inlet holes 11*a* at predetermined intervals along the circumferential direction at the side surface corresponding to the position for accommodating the microphone capsule 12.

There are provided outer cylinders 16 and 17 for shielding both the opening ends of the inner cylinder 11. These outer cylinders 16 and 17 are connected with each other through a screw portion for surrounding the inner cylinder 11. The outer cylinder 16 is formed with acoustic inlet holes 16*a* and 16*b* at the side surface portions corresponding to the holes 11*a* of the inner cylinder 11.

A cylindrical cover 18 is provided on the outer cylinders 16 and 17. This cover 18 is slidably attached to the periphery of the outer cylinder 17 at one opening end and horizontally movable along the axial direction of the outer cylinder 17 for opening and closing the holes 16*b* at the side surface of the outer cylinder 16.

With such construction, in case that the cover 18 is moved backwards on the outer cylinder 17 as illustrated, the acoustic inlet holes 16*b* of the outer cylinder 16 are opened.

Under such condition, an acoustic sound is transmitted to the condenser microphone of the microphone capsule 12 through the acoustic inlet holes 16*a* and 16*b* at the front end surface and the side surface of the outer cylinder 16, respectively. In this case, the acoustic sounds transmitted from the side of the outer cylinder 16 reach the microphone capsule 12 through the acoustic inlet holes 16*a* and 16*b* in opposite phases, so that these sounds are cancelled with each other and attenuated, and as a result, the sound transmitted from the front end surface direction of the outer cylinder is only clearly emphasized by attenuation of the sounds transmitted from the side direction. The condenser microphone of the microphone capsule 12 selectively catches the sound transmitted only from the front end direction of the outer cylinder 16.

When the cover 18 is moved forwards on the outer cylinder 16 along the outer cylinder 17, the acoustic inlet holes 16*b* at the side surface of the outer cylinder 16 are closed.

Under such condition, the acoustic sound is only transmitted to the condenser microphone of the microphone capsule 12 through the acoustic inlet holes 16*a* at the front end surface of the outer cylinder 16. In this case, however, the sound transmitted through the acoustic inlet holes 16*a* is mixed with the sound transmitted from the side of the outer cylinder 16, so that the condenser microphone of the microphone capsule 12 can simultaneously catch the sounds transmitted from many directions.

The microphone device according to the present invention is thus provided with the outer cylinders having acoustic inlet holes at the front end surface and the side surface near the microphone for surrounding the inner cylinder for accommodating the microphone body and further provided with a cover for opening and closing the acoustic inlet holes at the side portion of the outer cylinder. By opening or closing the acoustic inlet holes by the cover, not only the sounds transmitted from many directions but also the sound transmitted from one direction can selectively be caught, so that the microphone device is widely used.

Figure 3A:
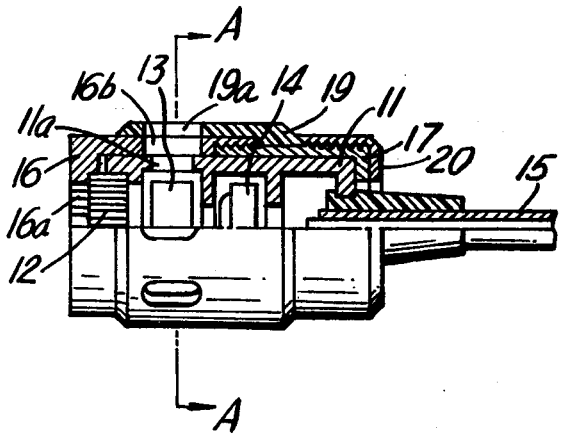
FIG. 3*a* is a partial cross-section showing third embodiment of a microphone device according to the present invention.
Figure 3B:
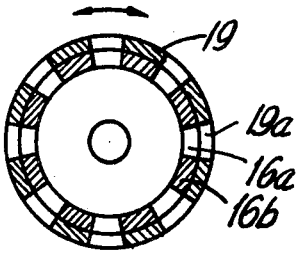
FIG. 3*b* is a cross-section taken on line A—A of FIG. 3*a;*.

Another embodiment of the present invention is now explained with reference to FIGS. 3*a* and 3*b*. Similar reference characters refer to similar elements or members in FIG. 2.

In this embodiment, a cylindrical cover 19 is provided on the outer cylinder 16. This cover 19 is provided with a plurality of acoustic inlet holes 19*a* corresponding to the acoustic inlet holes 16*b* at the side surface of the outer cylinder 16 in the circumferential direction. The cover 19 is sandwiched by the outer cylinder 16 and a cover holder 20 at one opening end and made rotatable around the outer cylinder 16.

When the cover 19 is rotated and its acoustic inlet holes 19*a* are put together with the acoustic inlet holes 16*b* of the outer cylinder 16 as shown, the sound is transmitted to the condenser microphone of the microphone capsule 12 through the front end surface of the outer cylinder 16 and the acoustic inlet holes 16*a* and 16*b* at the side surface. When the cover is rotated to shift the acoustic inlet holes 19*a* from the acoustic inlet holes 16*b* of the outer cylinder 16, the sound is transmitted to the condenser microphone of the microphone capsule 12 only through the acoustic inlet holes 16*a* at the front end surface of the outer cylinder 16 and an effect entirely same as that in the aforementioned embodiment can be obtained.

The present invention is not restricted by the above embodiments but can optionally be modified within the scope where the essential feature is not changed.

The position of the acoustic inlet holes formed in the casing can be changed in accordance with the position of the microphone, thereby changing the securing position of the shielding plate.

As described above in detail, the present invention provides a microphone device which can catch not only the sound transmitted from many directions but also the sound transmitted from one direction.

What is claimed is:

1. A microphone device comprising a microphone body, a tape recorder casing for incorporating the microphone therein, said casing having a front wall and a plurality of side walls extending from said front wall, said microphone body being located adjacent said front wall, acoustic inlet holes provided in said front wall and in at least two said side walls adjacent both said front wall and said microphone body, at least two shielding plates mounted on said casing each associated with a different one of said side walls for opening and closing the acoustic inlet holes in said side wall with which said shielding plate is associated, means mounted on said casing accessible from the exterior thereof for moving said shielding plates to open and close the acoustic inlet holes so that the directionality of the microphone can be selectively obtained by the separate actuation of said shielding plates.

* * * * *